United States Patent [19]

Lundh

[11] 4,033,281

[45] July 5, 1977

[54] EXTRA HEAVY DUTY HYDROSTATIC ANCHOR TOGETHER WITH ITS EXTRA HEAVY DUTY TETHER CABLE

[75] Inventor: Roy W. Lundh, Glendora, Calif.

[73] Assignee: Poseidom Marketing and Development Co., Arcadia, Calif.

[22] Filed: Jan. 7, 1976

[21] Appl. No.: 646,996

[52] U.S. Cl. ..... 114/295

[51] Int. Cl.[2] ..... B63B 21/28

[58] Field of Search ..... 114/206 R, 206 A, 16 R, 114/.5 D, 293, 294, 295; 61/46, 53.68, 94, 98–100

[56] References Cited

UNITED STATES PATENTS

| | | | |
|---|---|---|---|
| 2,503,516 | 4/1950 | Shrewsbury | 114/.5 D |
| 2,881,591 | 4/1959 | Reeve | 114/.5 D X |
| 3,299,645 | 1/1967 | Link | 114/16 R X |
| 3,314,239 | 4/1967 | Baron et al. | 61/46 |
| 3,315,629 | 4/1967 | Standridge et al. | 114/206 A |
| 3,330,338 | 7/1967 | Dozier | 61/46 |
| 3,824,794 | 7/1974 | Hubby | 61/46 |
| 3,861,157 | 1/1975 | Hillen | 61/46 X |
| 3,906,734 | 9/1975 | Pogonowski et al. | 61/46 |

*Primary Examiner*—Trygve M. Blix
*Assistant Examiner*—Sherman D. Basinger

[57] ABSTRACT

A permanent anchor embedded and encapsulated at unusual depth in the sea floor can become effected by ejecting an automatically fired chain tethered projectile into the sea floor and then covering it with a large mass of tremie concrete followed sequentially by the seizure to chains attached to the anchor flukes of the projectile by extra heavy duty tether cables only after the completion of the placement effort and making the tether cables vertically taut by means of a plurality of buoyant octahedrons.

9 Claims, 18 Drawing Figures

EXTRA HEAVY DUTY HYDROSTATIC ANCHOR TOGETHER WITH ITS EXTRA HEAVY DUTY TETHER CABLE

References cited for this filing:
3,080,583 R.B. Fuller; Mar. 13, 1963
3,360,810 G.E. Busking; Jan. 2, 1968
3,434,442 W.F. Manning; Mar. 25, 1969
B 379,955 Versluis et al. Jan. 28, 1975

SUMMARY OF THE INVENTION

Hydrostatic pressure may now be used as a very strong holding force for anchoring ships and other sophisticated objects to a permanent base that may be at unusually great depth.

A hinged flat plate is unfolded and encapsulated by a very large mass of tremie concrete in a manner that avoids allowing the concrete to be damaged by falling through the sea water and being separated as a result. The cap of concrete may then be supplemented by adding any additional amount of concrete required to fill voids or to increase the perimeter of the cap. Only two short pairs of tether ropes held taut by buoys are permanently attached during the placement procedure.

Permanent bonding of the flat plate to the sea floor is secured only after the concrete has cured. The weight of a column of water above this cap produces hydrostatic pressure. One pair of ropes transmits this holding power to the surface.

Complementary or supplementary holding power is transmitted by a second pair of ropes attached to a projectile buried deep in the sea floor. When the placement vehicle makes contact a gun is fired automatically to propel a square steel shaft and its attached folding arms.

BRIEF DESCRIPTION OF THE DRAWINGS

FIG. 1 shows the tethered vehicle in a descending mode while

The diversity of the many functions of this specification may be better comprehended if a list of each element and the purported use of the element is supplied.

| Element | Its use |
|---|---|
| 1. The tethered vehicle | A propellant actuated anchor embedment structure |
| 2. Temporary tether cable | Retrieval of vehicle for reuse. |
| 3. Projecting arm | Sonar receiver, lighting fixture |
| 4. Projecting arm | TV camera or a manned capsule |
| 5. Hydraulic motor driven propellors | Give vehicle mobility during placement of anchor |
| 6. The Big Gun | Forcefully eject anchor downward |
| 7. Four little guns | Open bin gates |
| 8. The Base plate | A repository for plastic concrete. A bonding element |
| 9. The projectile | A long shanked embedded anchor |
| 10. Bin Gates | When opened release containers |
| 11. Reinforced plastic containers | A tethered bag with a detachable bottom |
| 12. Tether chain | Snarl free permanent link between nylon rope and anchor |
| 13. Fail safe shear pin | Temporary supporting device |
| 14. Extension barrel | Temporary support for Base Plate |
| 15. Frangible Piston Head | Temporary round cap for square anchor shaft |
| 16. Trigger | A fail safe detonating device. |
| 17. Pipe | A sleeve to prevent anchor chains being bonded to concrete |
| 18. Cup | Hold vertically closed the hinged anchor arms. |
| 19. Buoyant Octohedron | A support for four pendant nylon ropes |
| 20. Weight compensator | Give supplementary negative buoyancy for seizure of ropes to tether chains |
| 21. Peripheral cable. | A basic functional element of the octohedron |
| 22. Clamp | To lock bin gates in a closed position |
| 23. Buoy for tether chain | Keep chains vertically taut |
| 24. Heavy Duty Hinges | Streamline Base Plate |
| 25. Toggle switch | Ignite primer cap |
| 26. Detonator circuit | Ignite primer cap |
| 27. Tension spring | Activate toggle switch |
| 28. Hammer | A piston with enough mass to drive the anchor home |

DESCRIPTION OF THE INVENTION

Figure 1:
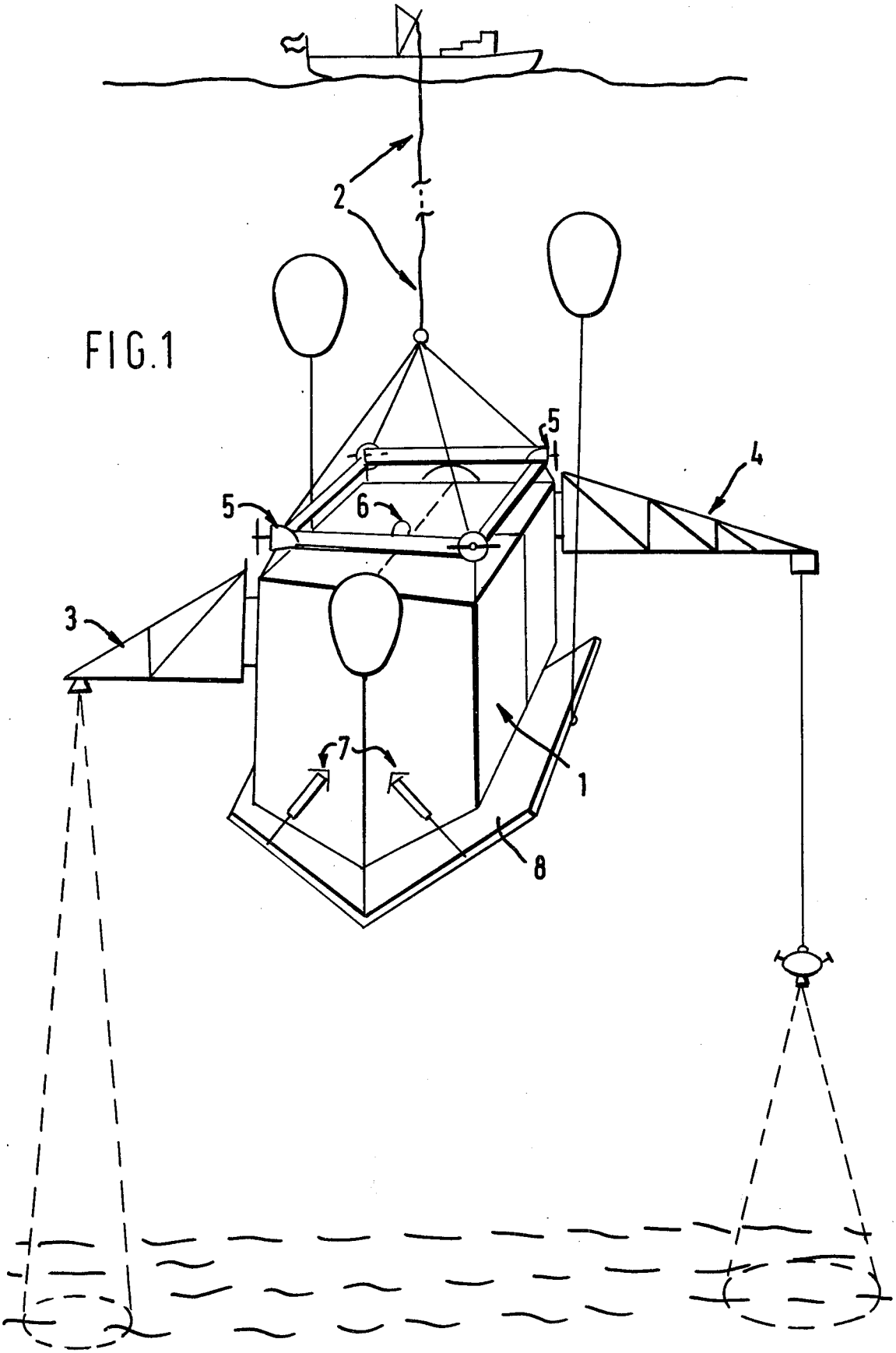

FIG. 1 shows a tethered vehicle 1 being lowered to the sea floor by a control ship. The tether cable uses a coaxial cable in its core to feed surface power to the vehicle and at the same time multiplex sonar and TV signals from the vehicle to the control ship.

A sonar pinger has been installed at a preselected flat site. The sonar transducer and high intensity lighting are attached to arm 3. A TV camera that can "swim" on its tether and look as commanded is suspended from arm 4.

The vehicle can also swim. Four motor driven propellors 5 controlled by a joy stick in the control room of the ship allow the vehicle to counter unknown adverse currents to home in on its target on the sea floor.

Figure 9:
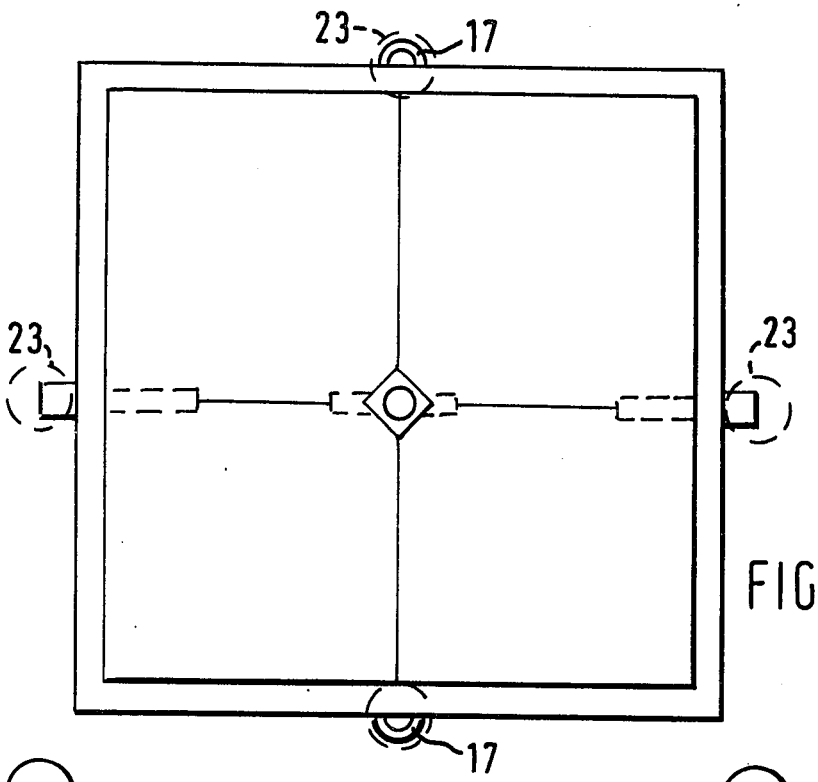
FIG. 9 is a detail of the Flat Plate. The anchor has been inserted into the muzzle of the Big Gun in FIG. 10.

A Big Gun 6 located at the junction of four tremie bins as shown in FIG. 9 fires a projectile on contact with the sea floor.

Four buoys assist the tether cable in supporting weight but only as a secondary function. Their primary function is to keep short lengths of the permanent tether cable attached at their bottom and to base plate 8 in a taut vertical position to be attached to a cable to the surface only after placement. Snarling, interference of the placement operation and slowing of the operation are all avoided by this procedure. Speed of placement is important to prevent the concrete from setting up.

Figure 2:
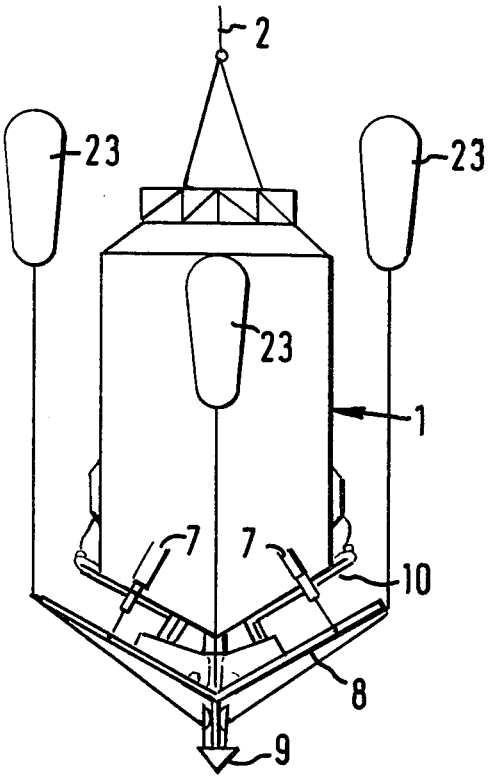
FIG. 2 is a detail of the approach to the sea floor. After contact the Big Gun fires

FIG. 2 is a more detailed view of the vehicle. When contact is made with the bottom a trigger fires the Big Gun 6.

Figure 3:
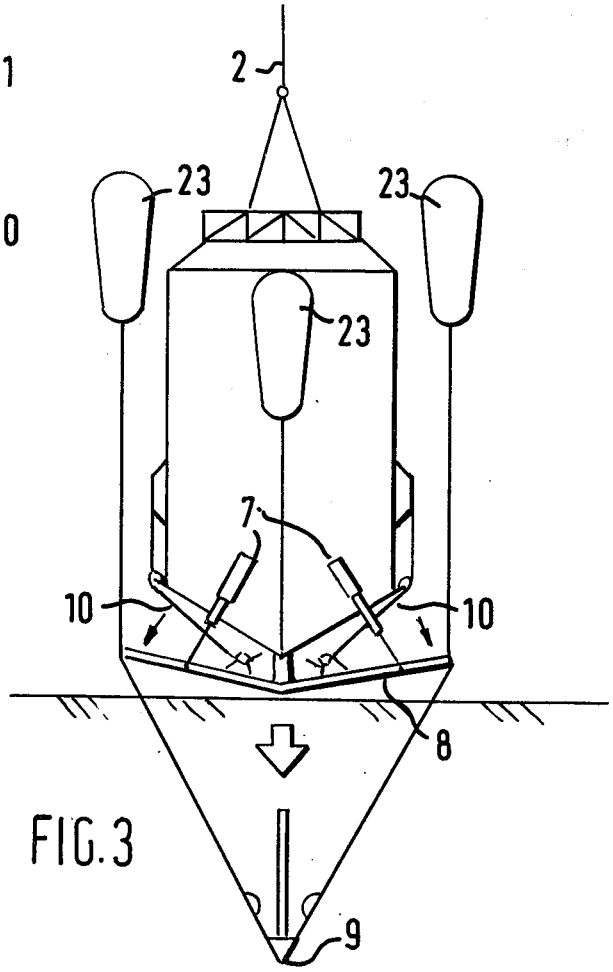
FIG. 3 shows the anchor being ejected into the sea floor.

FIG. 3 shows the projectile 9 fired by Big Gun 6 penetrating into the floor. At this instant a split second delay fires the four Small Guns 7 to eject and separate the base plate 8 from the vehicle. The Base Plate 8 is forced flat to the bottom. This movement automatically opens four bin, gates one at the bottom of each tremie bin and allows packaged concrete to drop intact as an entity directly onto the plate.

The weight of the concrete has now been transferred to the Base plate. A split second earlier this weight had been used to contain recoil, and this weight was then needed to drive the projectile to the point of refusal as shown in FIG. 3

Figure 4:
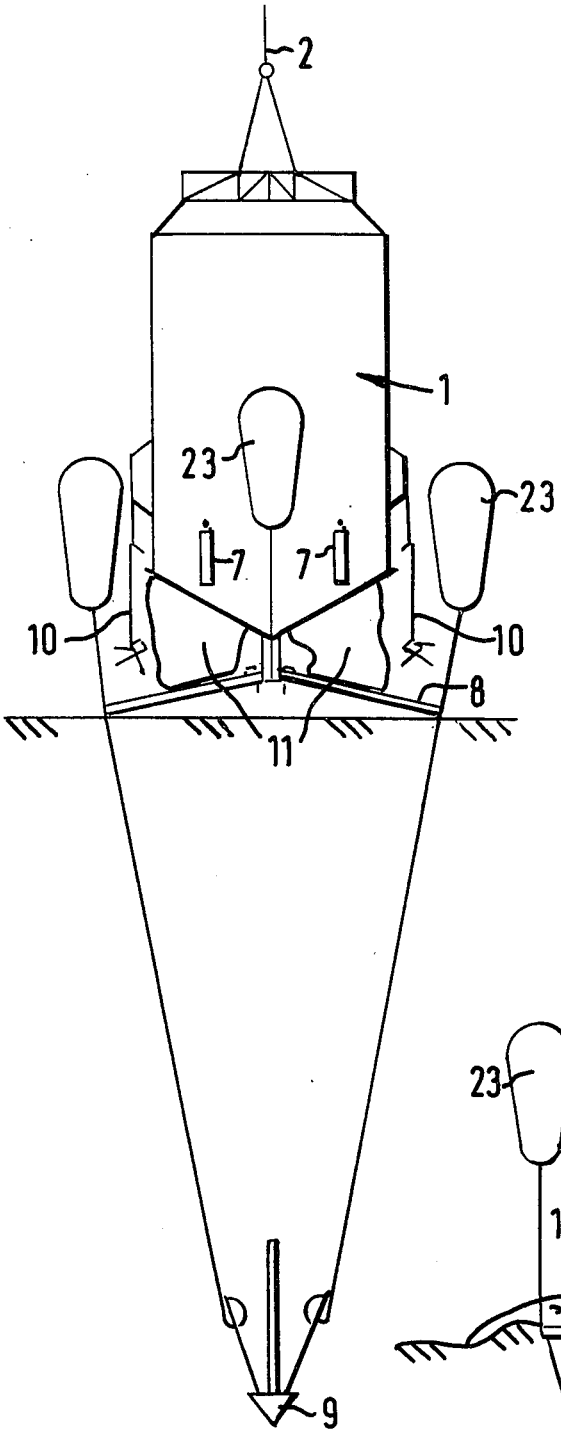
FIG. 4 shows the anchor at the point of refusal and gas from the gun barrel escaping from beneath the Base Plate. Recoil from the gun now acts to jerk the vehicle upward as shown in FIG. 5 with the containers having dropped their load on the Base Plate.

FIG. 4 shows a bubble of escaping gunsmoke making a slight lift to the Base Plate at its hinged joint. The projectile has now reached its point of refusal which will vary with resistance of basement soils to penetration. We can expect penetrations to 50 feet in soft clays, to 20 feet in packed sand and gravel, and 6 to 8 feet in rock provided the shank now has a sharp hardened tip.

Figure 13:
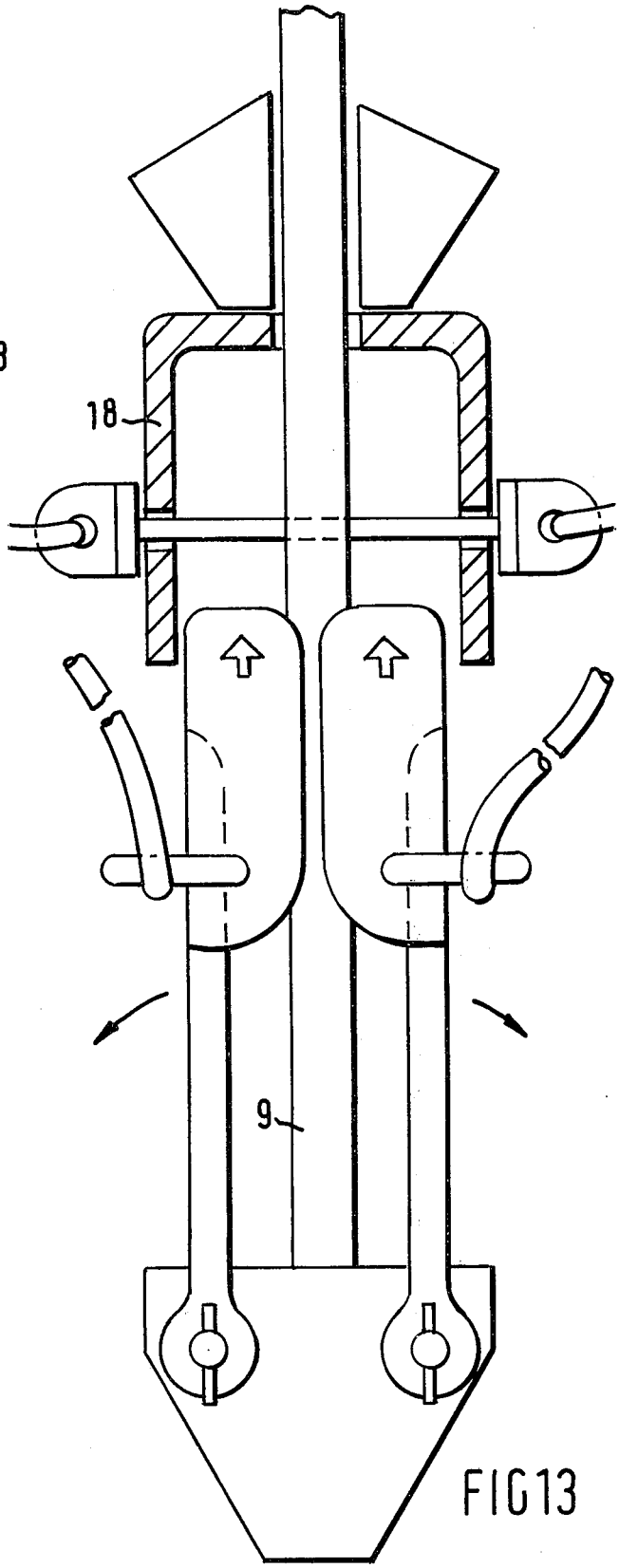

In effect the projectile is an anchor with folded tethered arms that open when the tether exerts a pull. The stronger the pull the wider they must open. This is shown in FIG. 4 and FIG. 13.

Figure 5:
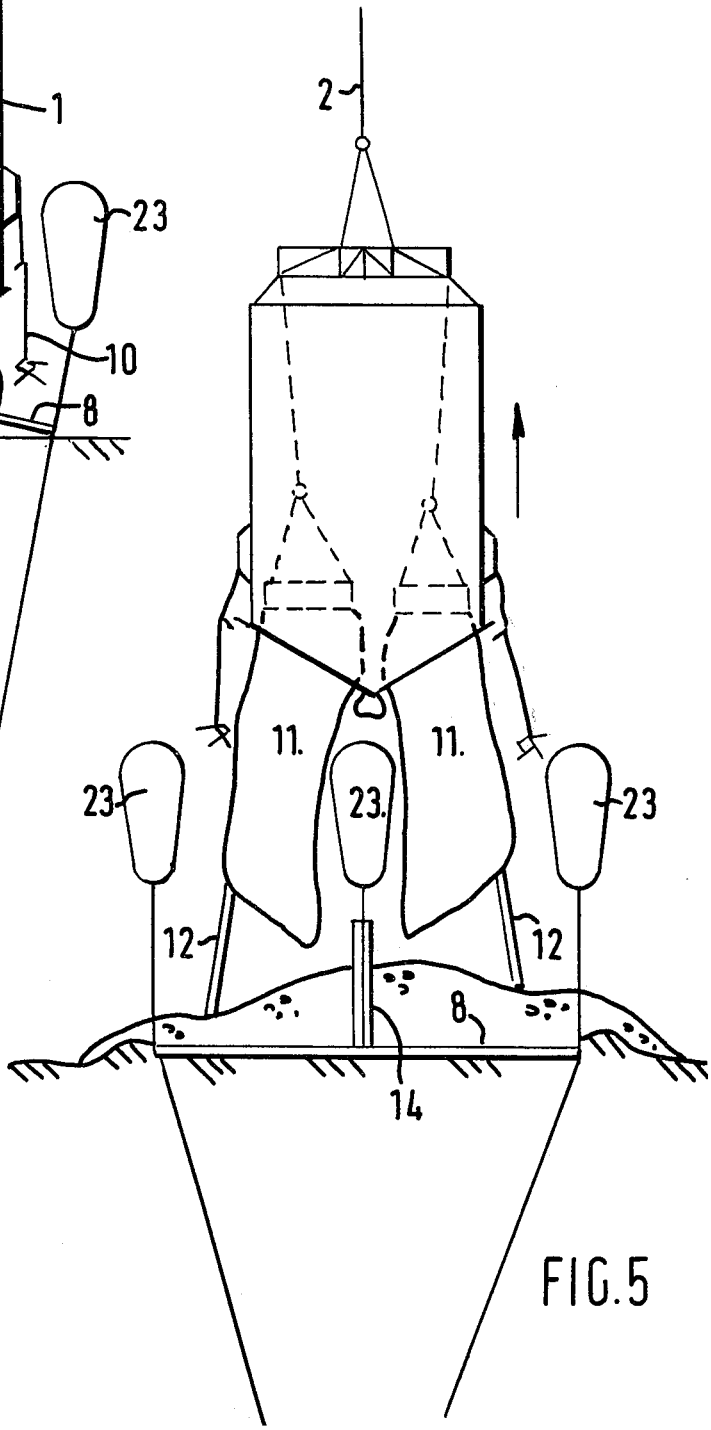

The concrete is held in reinforced flexible bags 11 as shown in FIGS. 4 and 5. One bag is located in each tremie bin. Each bag is held to a false bottom 12 by a spring tensioned restraining belt (not shown).

In FIG. 5 remaining recoil plus a pull from the surface pulls the containers away leaving the concrete to slump onto the base plate.

Supplemental tremie is required to fill voids and can be used to extend the perimeter of the cap to any desired size. The delivery bins for this concrete are smaller and have power actuated bin gates controlled visually by a crew member of a surface powered mini sub through the tether cables.

Illumination is provided by vehicle 1. Darkness prevails at operating depth in most cases.

Figure 6:
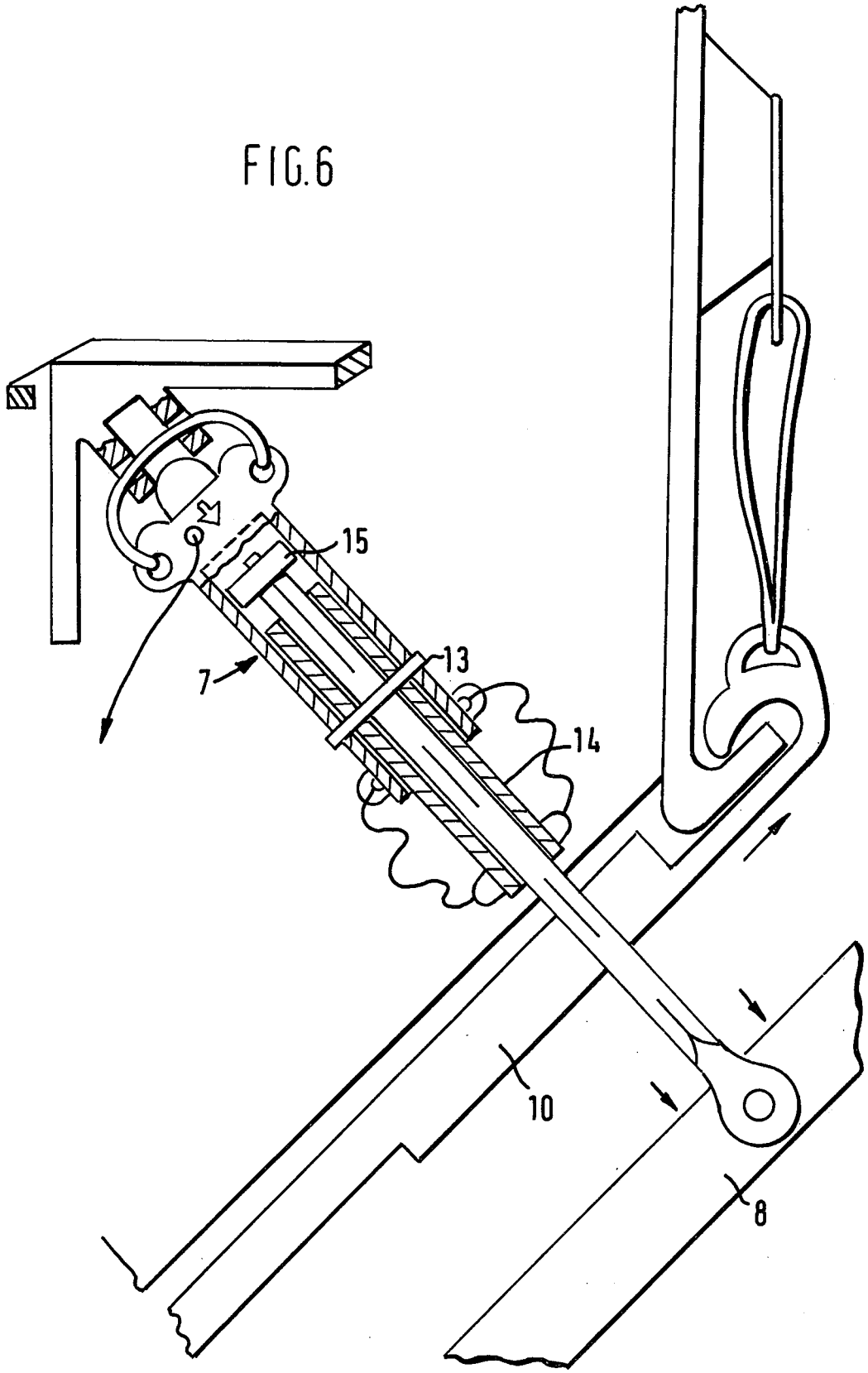
FIG. 6 is a detail of the small gun holding the Base Plate in a closed attitude and shows a method of holding a bin gate to the vehicle.

FIG. 6 is a detail to illustrate how the Base Plate is temporarily supported by the Small Gun 7. After the primer fires the gun a fail safe shear pin 13is severed. A round frangible cap 15 attached to the square piston rod forces the rod to move downward but is broken off on passing through the extension barrel 14 which prolongs the period of propulsion. The outward movement of the extension barrel severs the shear pin. A ball joint or similar allows the base of the gun to swivel and accomodate to the movement of the changing arc of the piston rod as it follows the base plate down and away from the vehicle. The piston rod finally disengages.

The upper portion of the bin gate 10 is shown hooked to the protruding edge of the bin. This allows the bin gate to swing out and down when the gate is opened. A thong retrieves the gate for reuse.

Figure 7:
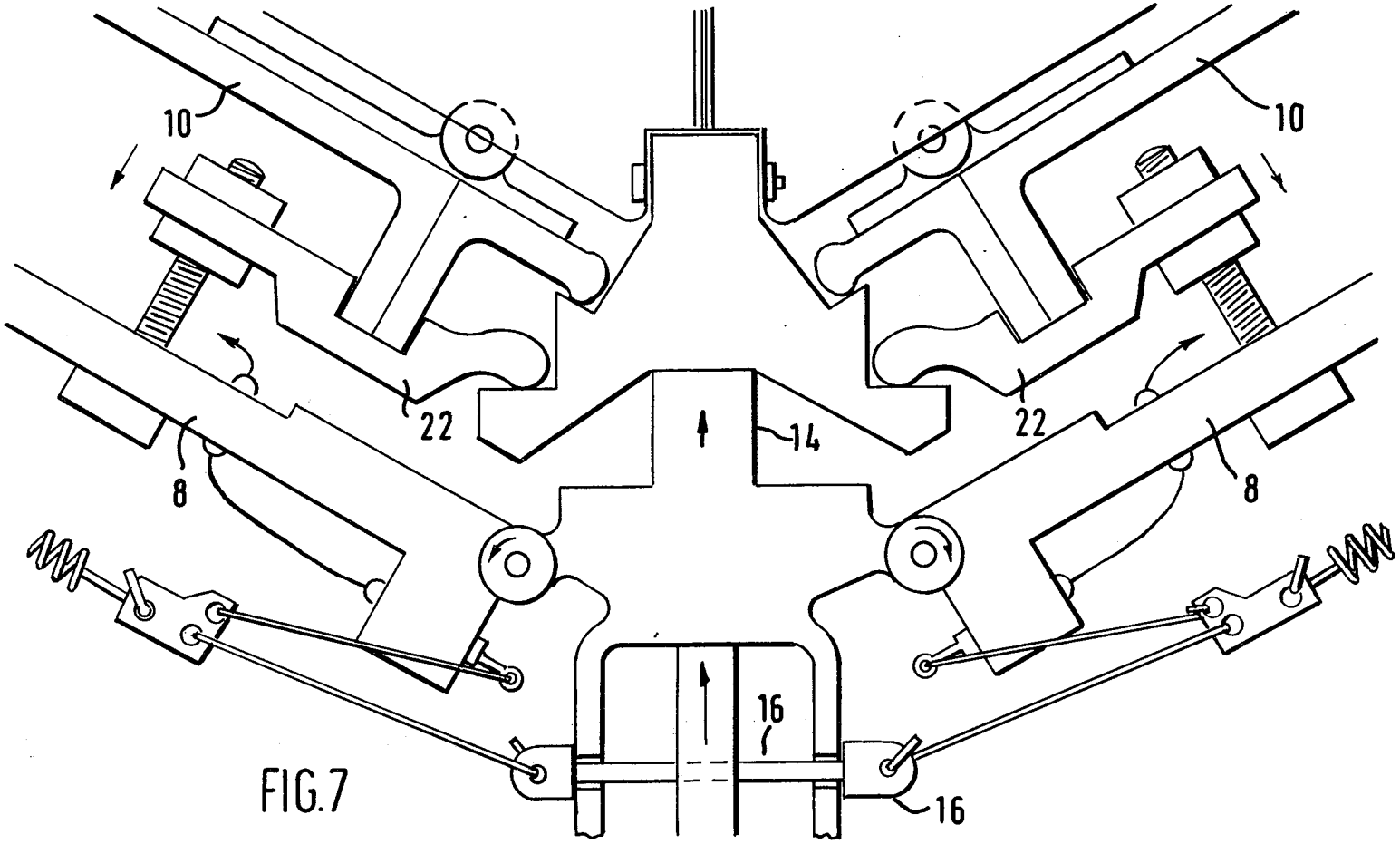
FIG. 7 shows a detail of the bin gate. As a result of bevelling each of the four adjacent corners of each bin a square column is formed at the center of the four bins.

FIG. 7 is a detailed view of the lower end of a pair of bin gates or bin gates 10, showing the hinged section of the Base Plate. When the Base Plate 8 moves down it pulls a cantilevered clamp 22 with it to release the short coupled hinged gates causing the gates to collapse from the weight of concrete.

The trigger 16 for all five guns is sheared off by the flukes of the projectile on impact of the vehicle 1 with the sea floor. In FIG. 13 the arrows at the top point out how the fluke moves up to shear trigger 16. Tension springs are released to activate a pair of toggle switches to fire the primer caps of the big gun and the small guns. The use of two switches provide for back up reliability.

Figure 8:
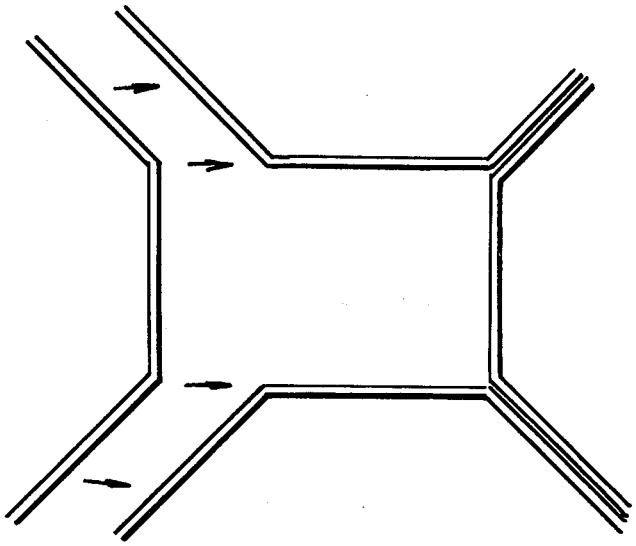
FIG. 8 illustrates the coming together of the bins.

FIG. 8 simply illustrates how four bins with bevelled common corners may be mated to form a hollow vertical column.

A relatively thin walled metal gun barrel may be very greatly strengthened by reinforcing it with wraps of fiberglass cloth embedded in urethane. The reinforeced gun is now inserted in the hollow column just described to be further reinforced by a spongy form of fiberglass impregnated with urethane foam to completely fill the void in the hollow column. The filled bins also reinforce. The Big Gun now has enormous strength.

FIG. 9 is a mid section of the vehicle as seen from the top of the vehicle. The Big Gun 6 is in place. Loops 17 keep permanent Tether Cable end sections leading to the projectile in a desired alignment.

Figure 10:
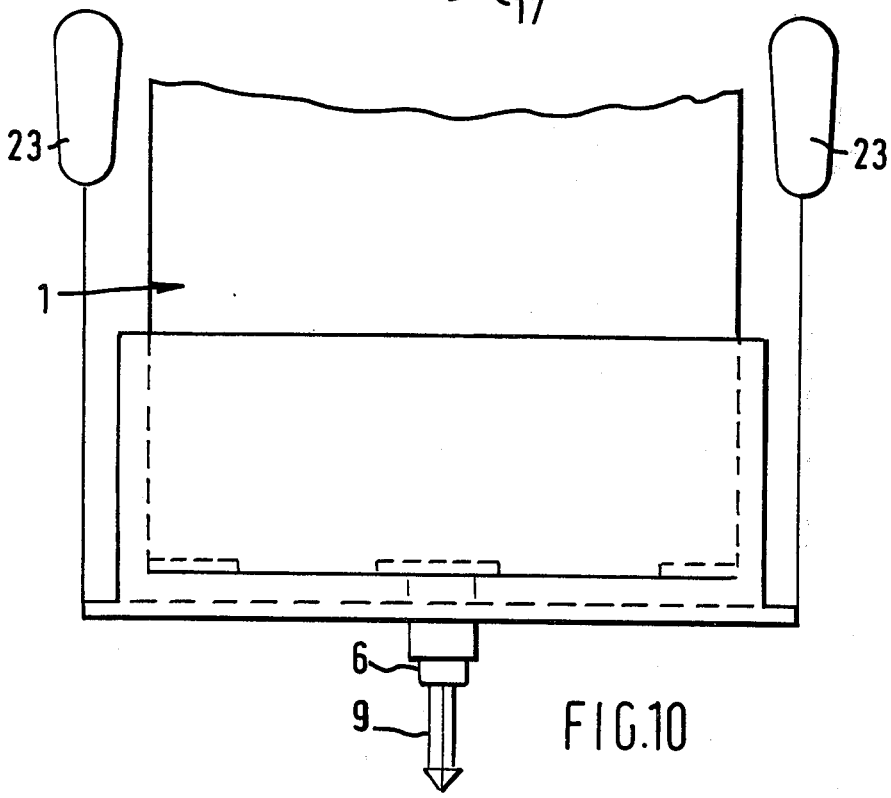

FIG. 10 shows the second pair of Permanent Tether Cable ends with buoys to prevent miring of them in the concrete. The Base Plate 8 is shown in side view. The hinged pair of plates fold down to form a square Base. The Base is a strongly braced flat steel Beam member using an alloy that is rust resistant.

Figure 11:
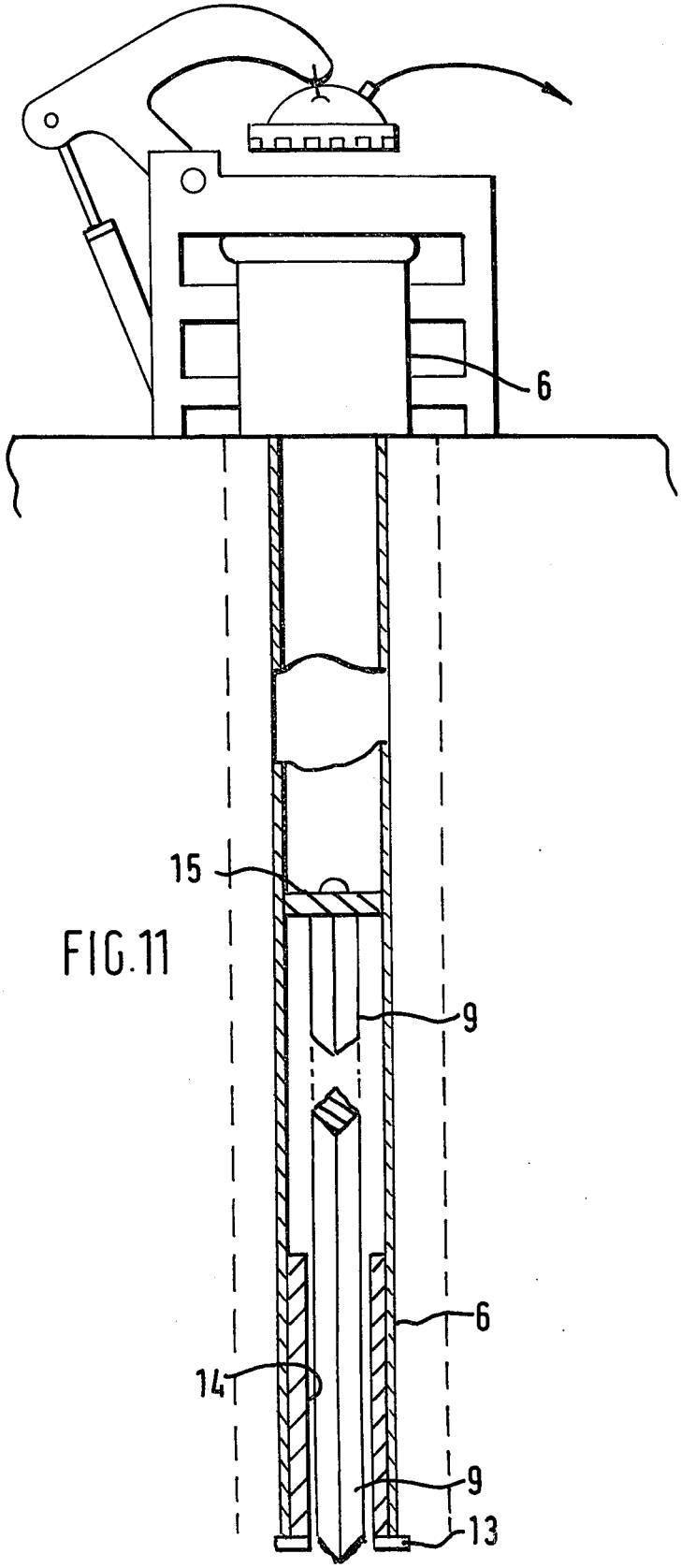
FIG. 11 shows the upper portion of the Big Gun with a cantilevered arm holding the breech for reloading.

FIG. 11 is a detail of the top section of the Big Gun 6.

A pivoted cantilevered rocker arm contains recoil. It is actuated by a heavy duty hydraulic jack to also lift the heavy breech block in order to service the gun after firing. The breech is locked by a slight twist.

Another frangible cap 15 makes a round cap on the square shank of the projectile. As before it breaks off while travelling past the end of the extension barrel. Again fail safe shear pins 13 temporarily support the hinged section of the Base Plate before firing.

Figure 12:
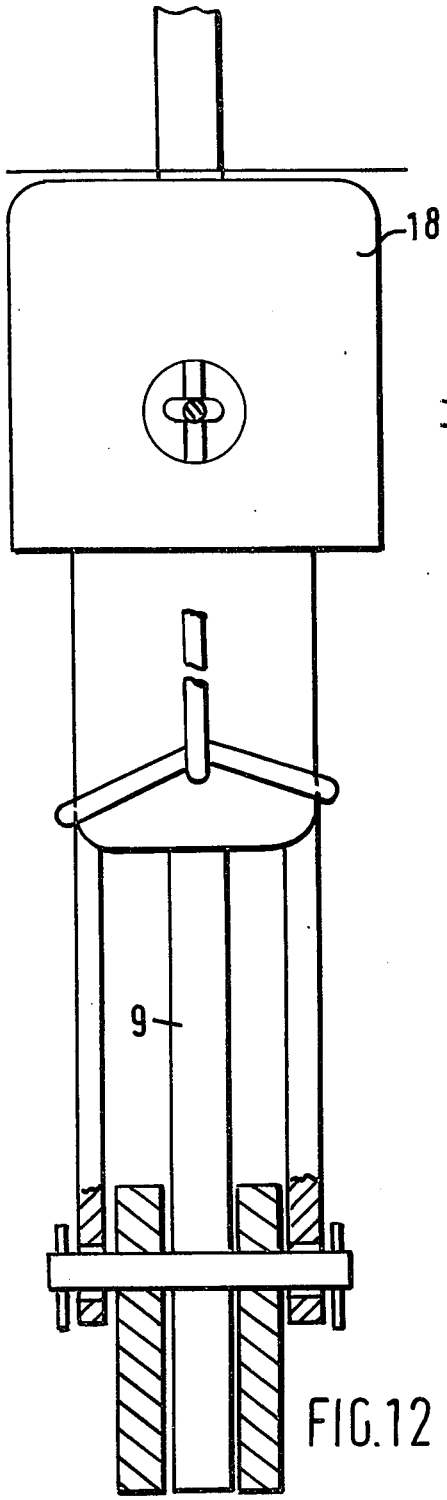
FIGS. 12 and 13 are views of the cup holding the anchor arms in position to sever the trigger.

FIG. 12 is a side view of the Projectile. The flukes are encapsulated by a cup 18.

FIG. 13 again shows the trigger mechanism 16 before contact. The flukes sever the trigger 16 to cause the guns to fire.

Figure 14:
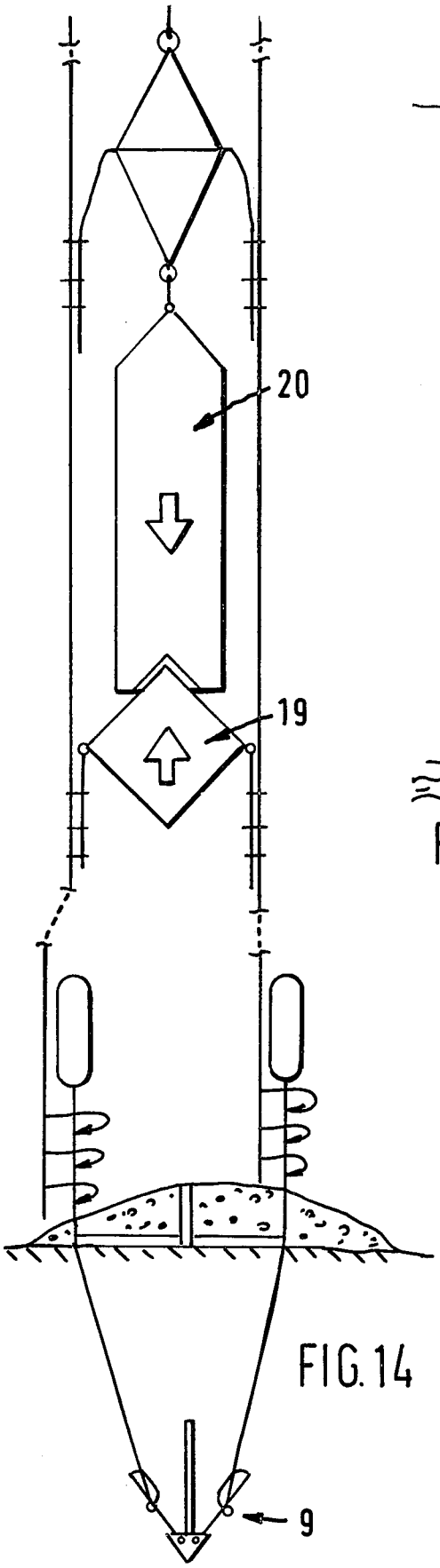
FIGS. 14, 15 and 16 give details of the seizure of the permanent tether ropes to the anchor chains.

FIG. 14 illustrates the initial placement of one pair of ropes to deeply buried end sections of the permanent tether cables held taut by buoys. This pair of buoys can be readily identified since they are fitted with sonar pingers. This device makes the ropes easy to find in the dark.

There are a very great variety of methods of splicing and attaching rope ends. A simple bolt on clamp type is illustrated since it can be fitted by a diver working with simple tools. For very deep water some type of attachment made with the aid of a mechanical arm of a mini sub will be required.

Since only one pair of wire ropes initially are attached to the tether cables, a temporary weight 20 compensates for the weight of a pair to be added after the concrete has cured. Ths weight is removed when the second pair of ropes are attached. The weight 20 is a container of dry sand which can be released and dumped by opening a gate of its container.

A permanent taut vertical attitude is required to prevent slack being developed in the Cable. Without slack the line does not jerk, holding power is greatly increased, and strain on the cable is greatly reduced.

Buoyant Octahedrons 19 keep the cable taut. If the hollow octahedron is pressurized with air to equal the ambient pressure of the surrounding water the skin of the octahedron feels no pressure. Strength is greatly enhanced as a result.

It may be here noted that a 1 inch steel cable in 20,000 feet of water with only a 5 ton pull will fail. This failure is largely due to the weight of the cable itself.

Figure 15:
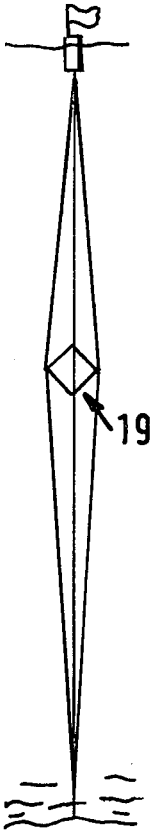

FIG. 15 is to illustrate a cable moored in 400 feet of water and using 1 octahedron for buoyancy. With each additional 400 feet of depth an additional octahedron is added.

Figure 16:
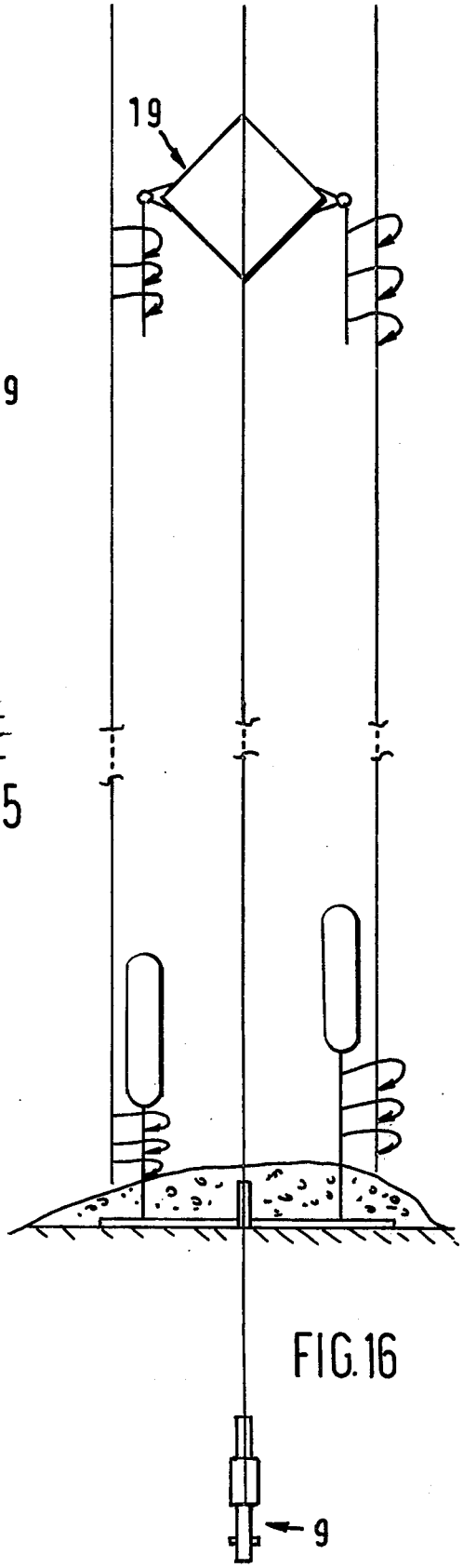

FIG. 16 is a side view of FIG. 14 to show the second pair of wire ropes added to complete the Tether Cable. The rope is unreeled from the surface.

Figure 17:
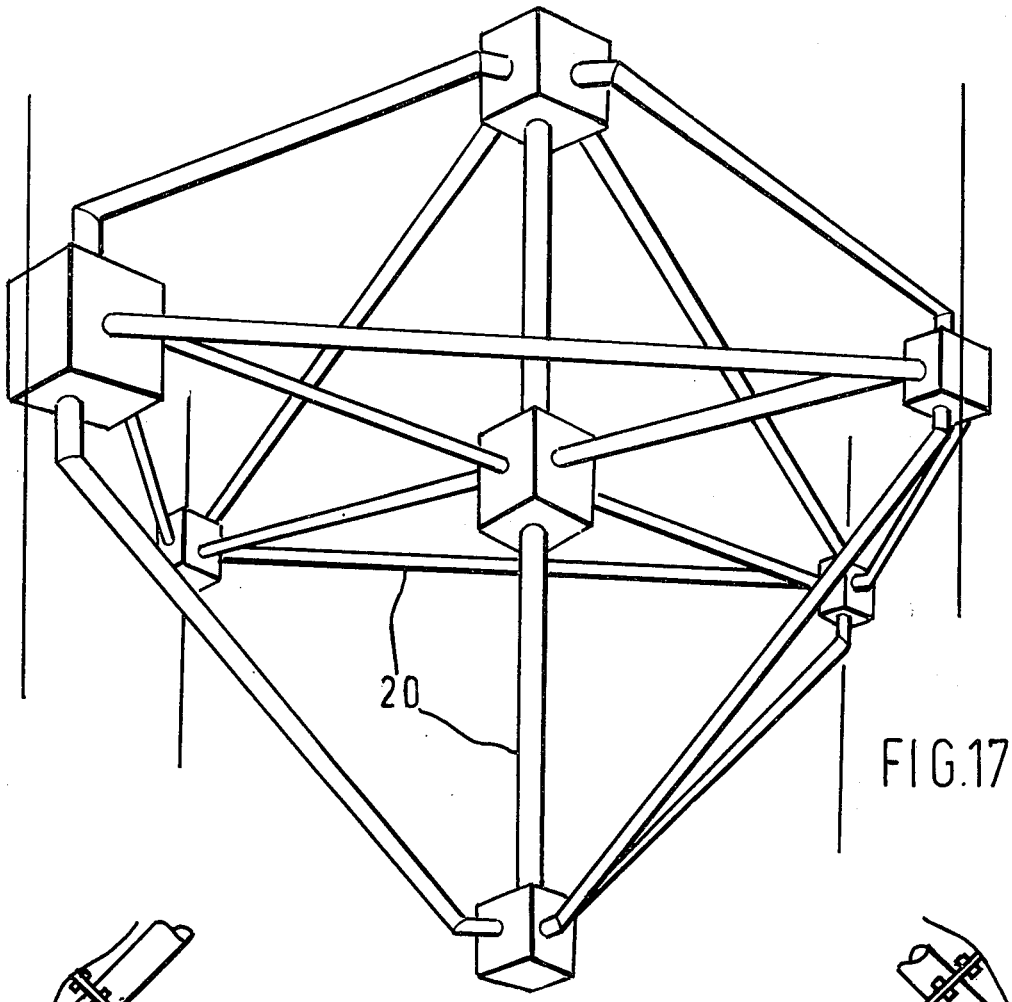
FIGS. 17 and 18 are details of the assembly of the buoyant octohedron.

FIG. 17 is a three dimensional view of the octahedron supporting four wire ropes.

Figure 18:
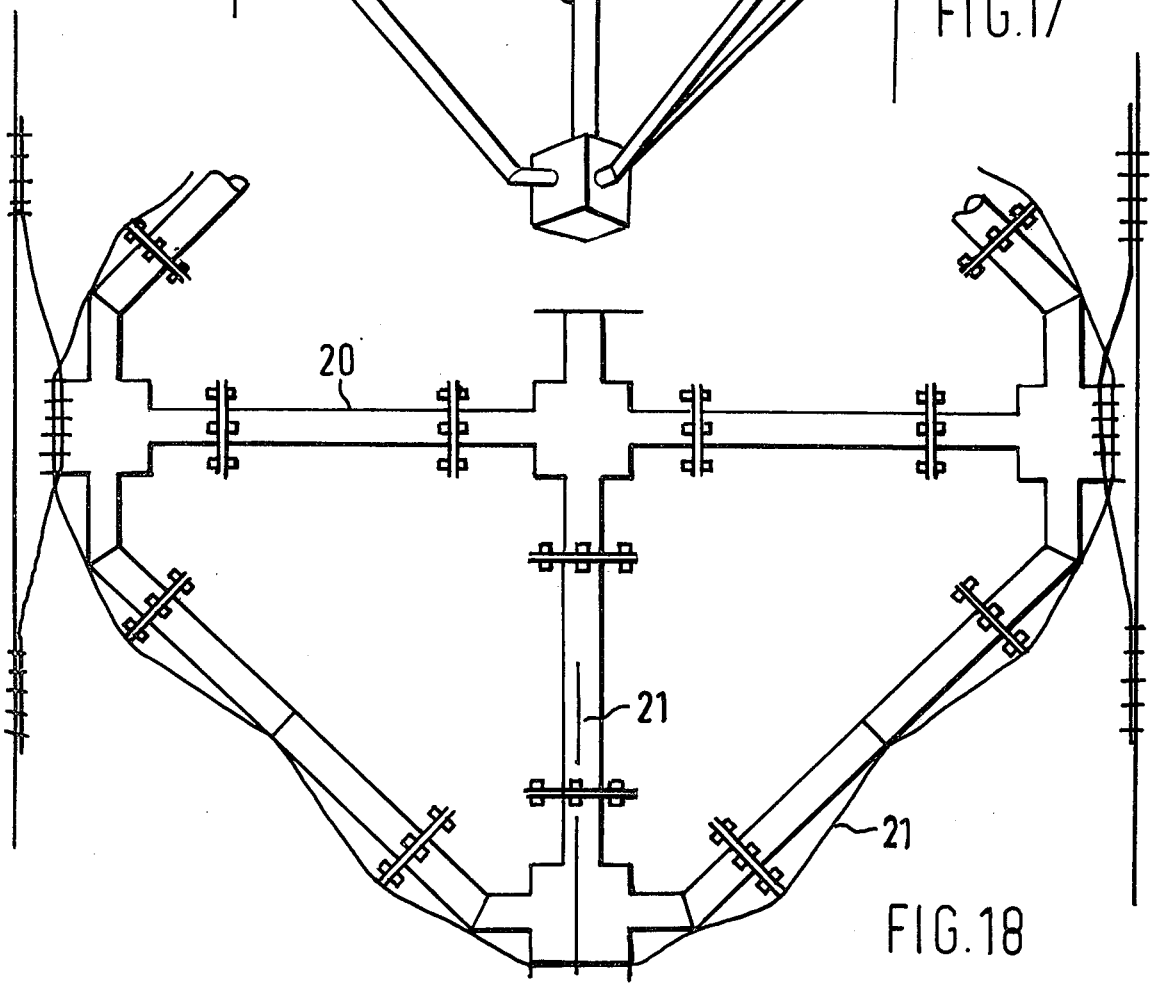

FIG. 18 is a detailed view of the octahedron. A pair of peripheral cables are secured to the structure as shown, and tension forces exerted on the octahedron become compression forces due to the unique nature of the octahedron shape and the peripheral cables. The shape is well suited to absorb compression force but ill suited to resist tension force. The addition of the peripheral cable makes this function possible.

I claim:

1. A tethered vehicle for placing a hydrostatic anchor on the sea floor comprising:

a plurality of bins containing concrete;

a big gun placed between said bins for firing a projectile into said sea floor;

said projectile having a plurality of flukes attached thereto, said flukes having at their unattached ends tether cables, each of which is attached to a buoy;

a base plate attached to said vehicle at the lower end of said bins;

a triggering means attached to said vehicle, said triggering means being activated by impact of said vehicle with said sea floor, said triggering means upon activation firing said projectile into said sea floor, releasing said base plate such that it is located on the sea floor above said projectile, and dumping said concrete upon said base plate;

whereby said tethered cables are securely anchored to the sea floor and said base plate forms a hydrostatic anchor.

2. The tetherd vehicle of claim 1 wherein said concrete is contained in a flexible reinforced container.

3. The tethered vehicle of claim 1 wherein there are four bins.

4. The tethered vehicle of claim 3 wherein each bin is bevelled such that said bins when mated form a hollow vertical column.

5. The tethered vehicle of claim 4 wherein said big gun is located in said hollow column.

6. The tethered vehicle of claim 1 wherein said triggering means comprises a trigger sheared by said flukes upon impact of said vehicle with said sea floor.

7. The tethered vehicle of claim 1 wherein ropes are attached to said tethered cables after they have been anchored.

8. The tethered vehicle of claim 7 wherein a buoyant octahedron is attached to said ropes at spaced intervals to prevent failure of said ropes resulting from the ropes own weight.

9. The tethered vehicle of claim 8 wherein said octahedron is provided with a tension cable around its periphery, said tension cable being attached to said ropes such that rope tension forces are relayed as compression forces to said octahedron.

* * * * *